US009595756B1

(12) United States Patent
Buckley

(10) Patent No.: US 9,595,756 B1
(45) Date of Patent: Mar. 14, 2017

(54) DUAL POLARIZED PROBE COUPLED RADIATING ELEMENT FOR SATELLITE COMMUNICATION APPLICATIONS

(71) Applicant: Rockwell Collins, Inc., Cedar Rapids, IA (US)

(72) Inventor: Michael J. Buckley, Marion, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 182 days.

(21) Appl. No.: 14/334,850

(22) Filed: Jul. 18, 2014

Related U.S. Application Data

(60) Provisional application No. 61/934,417, filed on Jan. 31, 2014.

(51) Int. Cl.

| | |
|---|---|
| ***H01Q 21/00*** | (2006.01) |
| ***H01Q 3/26*** | (2006.01) |
| ***H01Q 9/06*** | (2006.01) |
| ***H01Q 21/24*** | (2006.01) |

(52) U.S. Cl.
CPC ..... *H01Q 3/26* (2013.01); *H01Q 9/065* (2013.01); *H01Q 21/24* (2013.01)

(58) Field of Classification Search
CPC ..... H01Q 3/26; H01Q 9/065; H01Q 21/24
See application file for complete search history.

(56) References Cited

U.S. PATENT DOCUMENTS

| | | | | |
|---|---|---|---|---|
| 7,170,446 | B1 * | 1/2007 | West | H01Q 13/085 333/164 |
| 8,217,846 | B1 * | 7/2012 | Buckley | H01Q 1/00 343/730 |
| 8,872,713 | B1 * | 10/2014 | Buckley | H01Q 1/405 343/767 |
| 2004/0066345 | A1 * | 4/2004 | Schadler | H01Q 1/246 343/767 |
| 2010/0109966 | A1 * | 5/2010 | Mateychuk | A61N 1/37229 343/841 |
| 2013/0063310 | A1 * | 3/2013 | Mak | H01Q 1/246 343/700 MS |

* cited by examiner

*Primary Examiner* — Trinh Dinh
(74) *Attorney, Agent, or Firm* — Angel N. Gerdzhikov; Donna P. Suchy; Daniel M. Barbieri

(57) ABSTRACT

An antenna includes three metallization layers having metallic dipoles organized into two clusters. Each of the two clusters includes metallic dipoles generally elongated along a common axis to produce signals of specific polarization. Each of the two clusters is oriented orthogonal to the other to produce two separate, orthogonally polarized signals. Each of the two clusters is associated with a dedicated vertical probe, positioned to maximize gain of the radiating element.

20 Claims, 10 Drawing Sheets

FIG. 1

DUAL POLARIZED PROBE COUPLED RADIATING ELEMENT FOR SATELLITE COMMUNICATION APPLICATIONS

PRIORITY

The present application claims the benefit under 35 U.S.C. §119(e) of U.S. Provisional Application Ser. No. 61/934,417, filed Jan. 31, 2014, which is incorporated herein by reference.

FIELD OF THE INVENTION

The present invention is directed generally toward antennas, and more particularly to electronically scanned antennas.

BACKGROUND OF THE INVENTION

Current planar radiating element and manifold technology using high dielectric constant materials cannot provide an integrated manifold and radiating element feed layer and good scan and polarization performance. Conventional probe fed patch apertures have gain and polarization limitations. Electronically scanned arrays often employ a circularly polarized field. Single linear polarization imposes inherent limitations on satellite communication. Dual polarization, with signals 90° out of phase, would be preferable if it could be achieved per-unit-cell.

Electronically scanned antennas generally comprise a manifold layer for distributing power to a feed layer. The feed layer feeds power to an aperture layer that couples the power to free space. The aperture layer typically requires low dielectric constant materials that are unsuitable for FR-4 manufacturing processes. Furthermore, existing aperture layers are substantially thicker than the manifold or feed layers, creating an unbalanced circuit board.

Probe fed apertures generally comprise a low dielectric constant substrate and two printed circuit board patches. Patches tend to scatter into lower order Floquet modes. Lower order Floquet modes must be relatively constant over the scan volume and frequency band, necessitating a small unit cell size and a low dielectric constant substrate. The small unit cell size results in a high module density, significantly increasing the cost of the antenna and the thermal loading problem. Furthermore, aperture performance as a function of frequency and scan is sub-optimal. Cross-polar coupling at wide H plane scan angles is also high because the probe is asymmetrical with respect to the H plane.

Probe coupled radiating elements combine the manifold and feed layers of a comparable aperture coupled radiating element resulting in a significant reduction in cost and manufacturing complexity. Current planar radiating element technology cannot provide a relatively broadband (~30%) probe coupled dual polarized radiating element comprised exclusively of FR-4 materials, manufactured using standard printed circuit board (PCB) processes, and with a built in radome. Conventional probe coupled radiating elements require higher cost Teflon materials that are more expensive and difficult to manufacture than FR-4 materials. In addition, the unit cell size of a conventional probe coupled radiating element is small. Small unit cell size radiating elements are more expensive, and create module count, packaging, and heat dissipation problems.

Consequently, it would be advantageous if an apparatus existed that is efficient to manufacture and suitable for use as a radiating element having dual polarization in a single unit cell with moderately wide frequency bandwidth and scan volume, utilizing high dielectric constant materials.

SUMMARY OF THE INVENTION

Accordingly, the present invention is directed to a novel apparatus for use as a radiating element having dual polarization in a single unit cell with moderately wide frequency bandwidth and scan volume, utilizing FR-4 high dielectric constant materials.

In one embodiment, a radiating element includes two linearly polarized probe feeds, each associated with a plurality of metal elements in a metal layer. An antenna including apertures as described herein produces two polarized signals, 90° out of phase, per-unit-cell.

In this embodiment of the present invention, a radiating element configured for dual polarization utilizes higher order dielectric constant materials. In this embodiment, an antenna according to the present invention is manufactured using FR-4 manufacturing processes to produce a balanced printed circuit board.

It is to be understood that both the foregoing general description and the following detailed description are exemplary and explanatory only and are not restrictive of the invention claimed. The accompanying drawings, which are incorporated in and constitute a part of the specification, illustrate an embodiment of the invention and together with the general description, serve to explain the principles.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the subject matter disclosed, which is illustrated in the accompanying drawings. The scope of the invention is limited only by the claims; numerous alternatives, modifications and equivalents are encompassed. For the purpose of clarity, technical material that is known in the technical fields related to the embodiments has not been described in detail to avoid unnecessarily obscuring the description.

Figure 1:
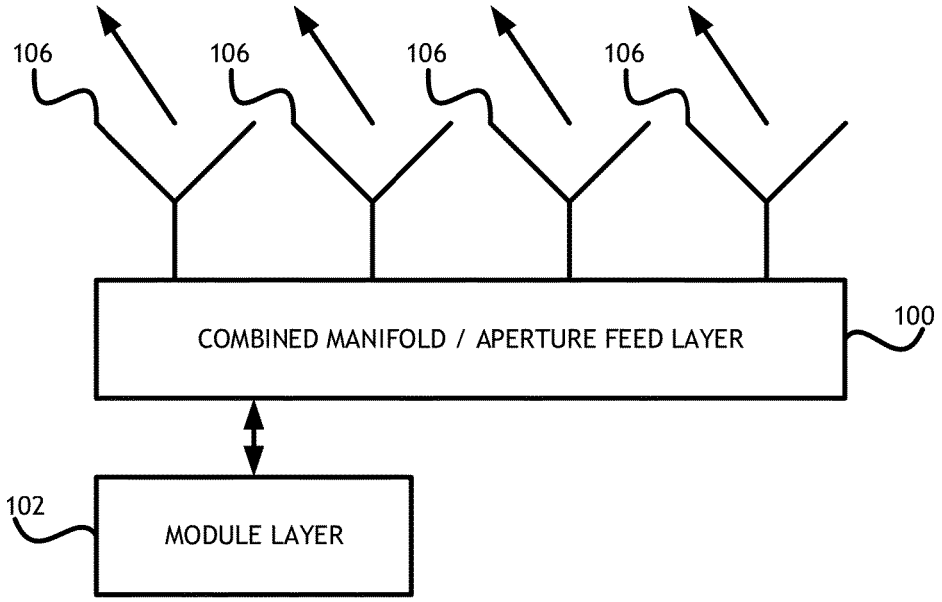
FIG. 1 shows a block diagram of an antenna system according to embodiments of the present invention.

Referring to FIG. 1, a block diagram of an antenna system according to embodiments of the present invention is shown. A system according to at least one embodiment of the present invention may comprise a combined manifold/aperture feed layer 100, a module layer 102 connected to the combined manifold/aperture feed layer 100 and a layer of radiating element unit cells 106 connected to the combined manifold/aperture feed layer 100. Each radiating element unit cell 106 generates two orthogonally polarized fields. The radiating element unit cells 106 comprise layers of FR-4 material with printed circuit patterns. The coupling from the radiating element unit cell 106 to the combined manifold/aperture feed layer 100 is via two vertical probes connecting the combined manifold/aperture feed layer 100 to one or more metallization layers.

At least one embodiment of the present invention may comprise an active electronically scanned antenna comprising a plurality of radiating element unit cells 106 of radiating elements 210. Each radiating element unit cell 106 having two probe fed inserts offers significant advantages in cost and packaging. Because probe feeds occupy substantially less area than stripline feeds, the manifold and aperture feed layers may be combined. Combining the manifold and aperture feed layers eliminates the separate stripline feed layer, reduces material costs and obviates a series of back drill and fill operations. A lamination step is also eliminated. Reducing a lamination step lowers manufacturing costs and improves via reliability over temperature cycles.

Figure 2:
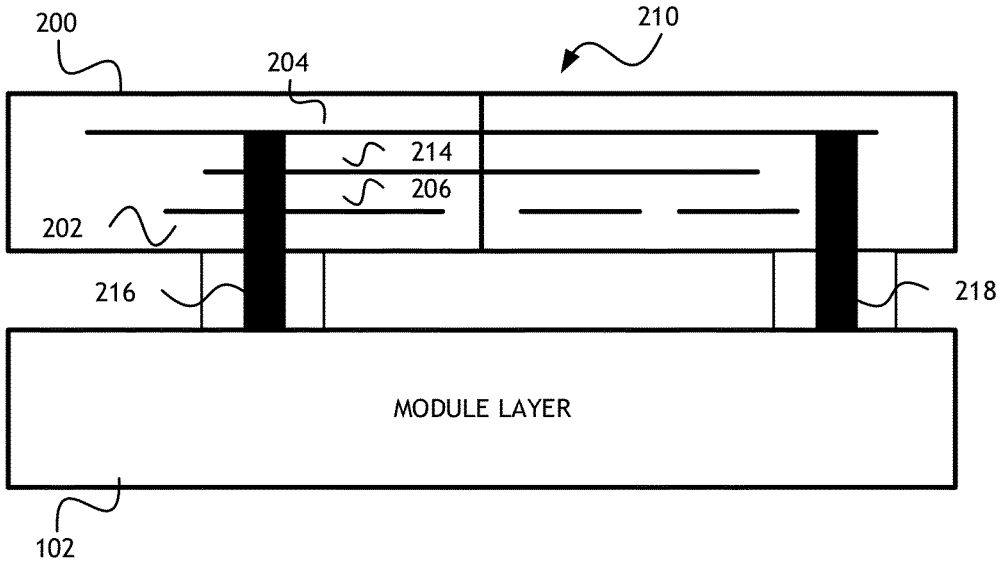
FIG. 2 shows a cross-sectional side view of a radiating element according to embodiments of the present invention with two penetrating vertical probes.

Referring to FIG. 2, a cross-sectional side view of a radiating element according to embodiments of the present invention with two penetrating vertical probes is shown. In at least one embodiment, a radiating element 210 comprises a number of printed circuit board layers; all printed circuit board layers comprise a high dielectric material suitable for FR-4 manufacturing processes. The printed circuit board is balanced to reduce warping.

The radiating element 210 may comprise a built in radome layer 200, an upper metallization layer 204, a mid-metallization layer 214 and a lower metallization layer 206 as described more fully herein. Two vertical probes 216, 218 connect all metal layers to a ground plane layer 202 and excite the lower metallization layer 206. The vertical probes 216, 218 connect all metal layers facilitating manufacturing. Furthermore, the vertical probes 216, 218 may connect the ground plane layer 202 to a module layer 102.

In at least one embodiment, a radiating element substrate has a height of 60 mils. In at least one embodiment, the substrate material is FR-4, having a dielectric constant of 3.7, and loss tangent of 0.008. In one embodiment, the unit cell size is $0.25\lambda^2$ at 14.5 GHz. Radiating elements according to the present invention may have scan performance less than −10 dB return loss out of 30° half conical scan angle for arbitrary phi angle.

In at least one embodiment, the radome layer 200 may comprise a layer of FR-4 applied at the end of the manufacturing process to protect the underlying metal layers. FR-4 may be applied without "potato-chipping" the board because the underlying layers are balanced.

Figure 3:
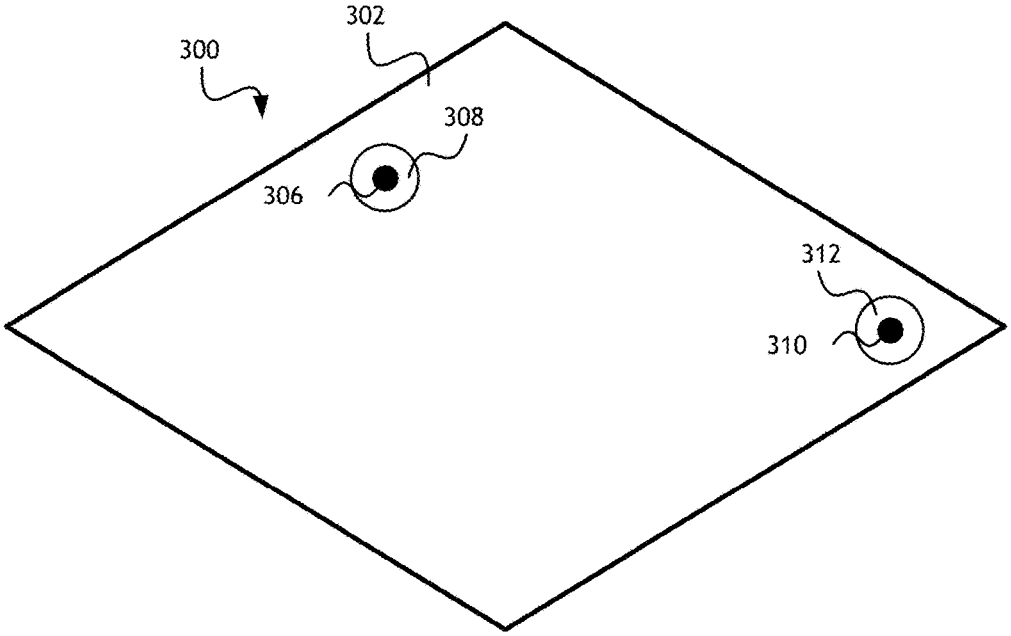
FIG. 3 shows a top view of a ground plane of a radiating element.

Referring to FIG. 3, a top view of a ground plane of a radiating element is shown. A radiating element 300 according to the present invention has a ground plane 302 layer. The ground plane layer 302 defines two openings 308, 312 each shaped to conform to a vertical probe 306, 310 connecting all the metal layers of the radiating element 300. The location of each vertical probe 306, 310 is determined in relation to the gain of the radiating element with respect to the metallic layers and the final geometry of the metallic dipoles of the radiating element as described herein.

Figure 4:
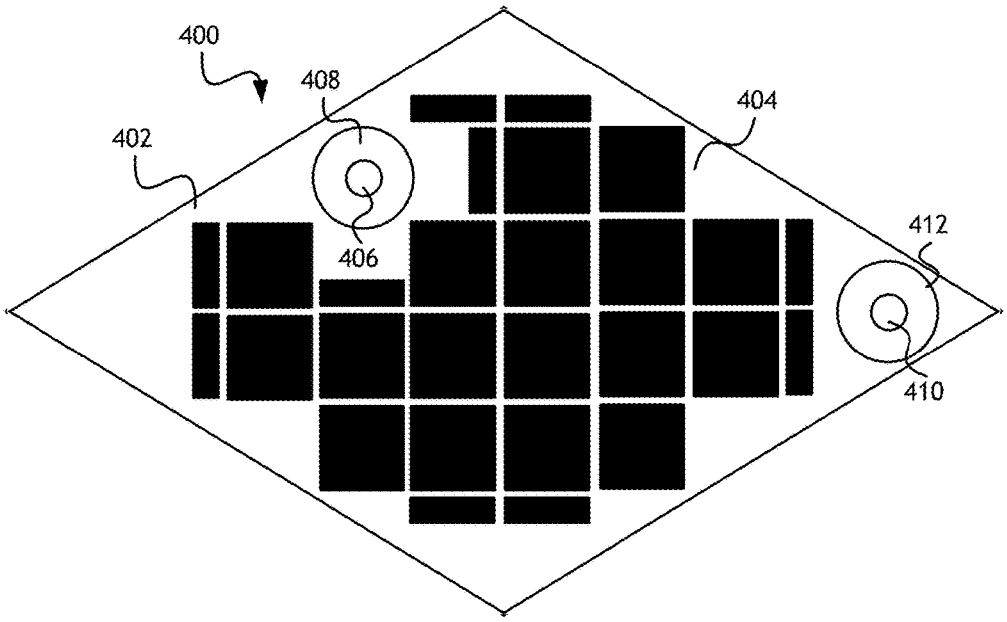
FIG. 4 shows a top view of a lower metallization layer of a radiating element according to embodiments of the present invention.

Referring to FIG. 4, a top view of a lower metallization layer of a radiating element according to embodiments of the present invention is shown. A radiating element 400 according to the present invention may include a lower metallization layer 402. The lower metallization layer 402 includes a plurality of metallic dipole strips 404, organized to tune the radiating element in a particular frequency range.

Figure 5:
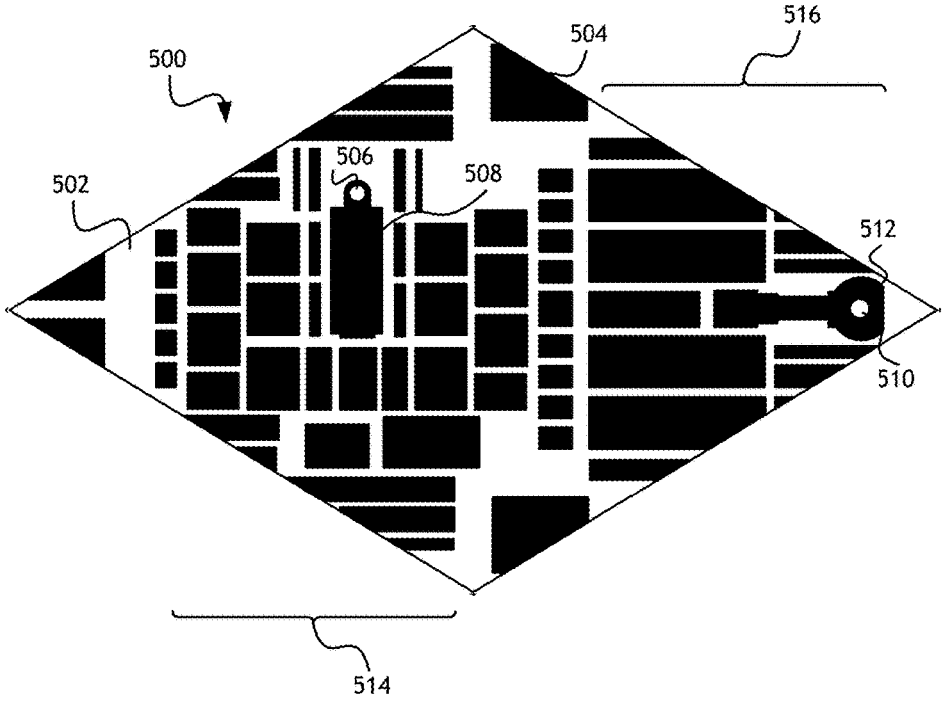
FIG. 5 shows a top view of a mid-metallization layer of a radiating element according to embodiments of the present invention.

Referring to FIG. 5, a top view of a mid-metallization layer of a radiating element according to embodiments of the present invention is shown. A radiating element 500 according to the present invention may include a mid-metallization layer 502. The mid-metallization layer 502 includes a plurality of metallic dipole strips 504, organized for wide angle scan. The dipole metallic strips may be excited by signals from a lower metallization layer such as in FIG. 4. The mid-metallization layer 502 may also include two catch pad connecting element 508, 512 to simplify manufacture and connect various metallic layers of the radiating element 500. The catch pad connecting element 508, 512 allow connection to corresponding vertical probes 506, 510.

Metallic dipole strips 504 may be organized into dipole strip clusters 514, 516 according to their proximity to a particular vertical probe 506, 510. For example, a first dipole strip cluster 514 may include metallic dipole strips 504 oriented to produce a certain polarization when a signal is received from the first vertical probe 506. Likewise, a second dipole strip cluster 516 may include metallic dipole strips 504 oriented to produce a different polarization when a signal is received from the second vertical probe 510. In at least one embodiment, the metallic dipole strips 504 in the first dipole strip cluster 514 are generally oriented 90° offset from the metallic dipole strips 504 in the second dipole strip cluster 516.

Figure 6:
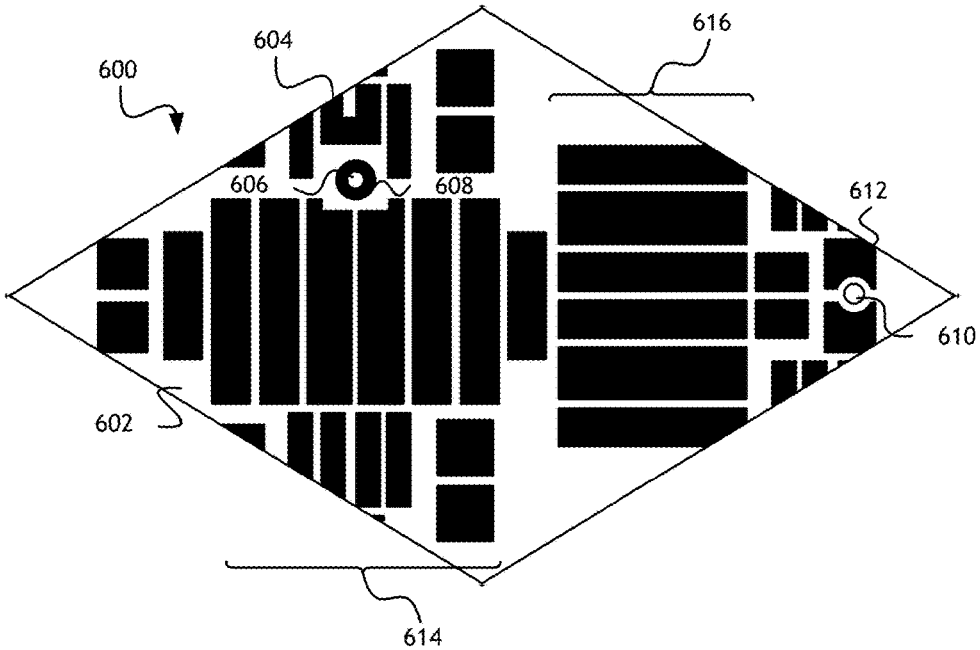
FIG. 6 shows a top view of a upper metallization layer of a radiating element according to embodiments of the present invention.

Referring to FIG. 6, a top view of an upper metallization layer of a radiating element according to embodiments of the present invention is shown. A radiating element 600 according to the present invention may include an upper metallization layer 602. The upper metallization layer 602 includes a plurality of metallic dipole strips 604, organized for wide angle scan. The dipole metallic strips may be excited by signals from a lower metallization layer such as in FIG. 4. The upper metallization layer 602 may also include a plurality of catch pad connecting elements 608, 612 to simplify manufacture and connect various metallic layers of the radiating element 600. Such catch pad connecting elements 608, 612 allow for allow electronic communication between vertical probes 606, 610 associated with the catch pad connecting elements 608, 612 and the metallic dipole strips 604.

Metallic dipole strips 604 may be organized into dipole strip clusters 614, 616 according to their proximity to a particular vertical probe 606, 610. For example, a first dipole strip cluster 614 may include metallic dipole strips 604 elongated along one axis, and oriented with each elongated axis to produce a certain polarization when a signal is received from the first vertical probe 606. Likewise, a second dipole strip cluster 616 may include metallic dipole strips 604 elongated along one axis, and oriented with each elongated axis to produce a different polarization when a signal is received from the second vertical probe 610. In at least one embodiment, the metallic dipole strips 604 in the first dipole strip cluster 614 are generally oriented 90° offset from the metallic dipole strips 604 in the second dipole strip cluster 616. Orthogonal orientation of metallic dipole strips 604 induces orthogonal polarization.

A person skilled in the art may appreciate that while the exemplary embodiment described herein is specifically directed toward metallic dipole strips 604 organized into dipole strip clusters 614, 616 in an upper metallization layer 602, metallic dipole strips organized into dipole strip clusters in other metallization layers may also be effective in producing per-unit-cell dual polarization. Radiating elements according to embodiments of the present invention may produce a per-unit-cell dual polarized signal suitable for satellite communication.

Figure 7:
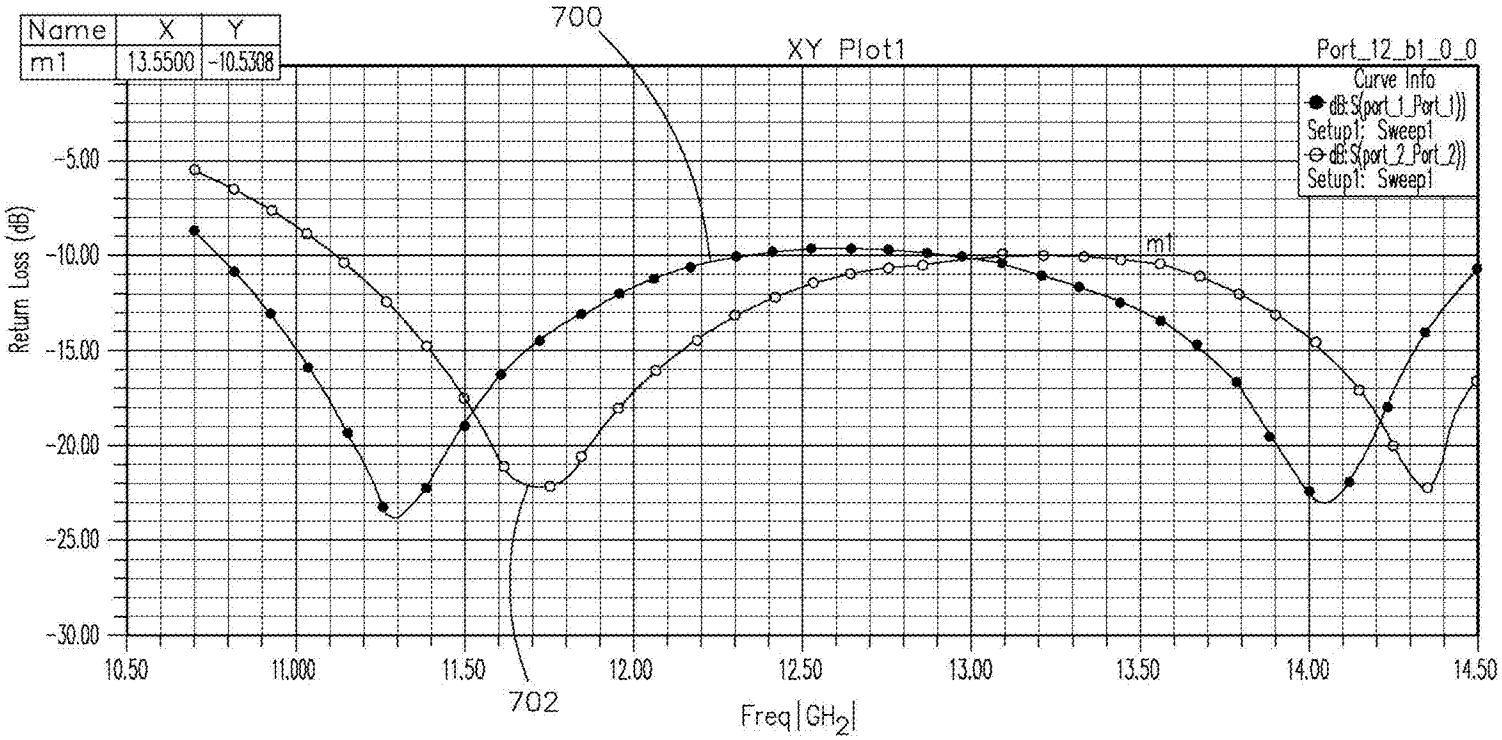
FIG. 7 shows a graphical representation of the performance of a radiating element according to at least one embodiment of the present invention.

Referring to FIG. 7, a graphical representation of the performance of a radiating element according to at least one embodiment of the present invention is shown. In at least exemplary embodiment of the present invention, the performance of a radiating element operating with θ (theta) of 30 degrees and ϕ (phi) of 0 degrees is shown in a frequency range of 10.7 to 14.5 GHz. Performance is measured as return loss in decibels. Return loss is shown for a horizontal polarization 700 and a vertical polarization 702.

Figure 8:
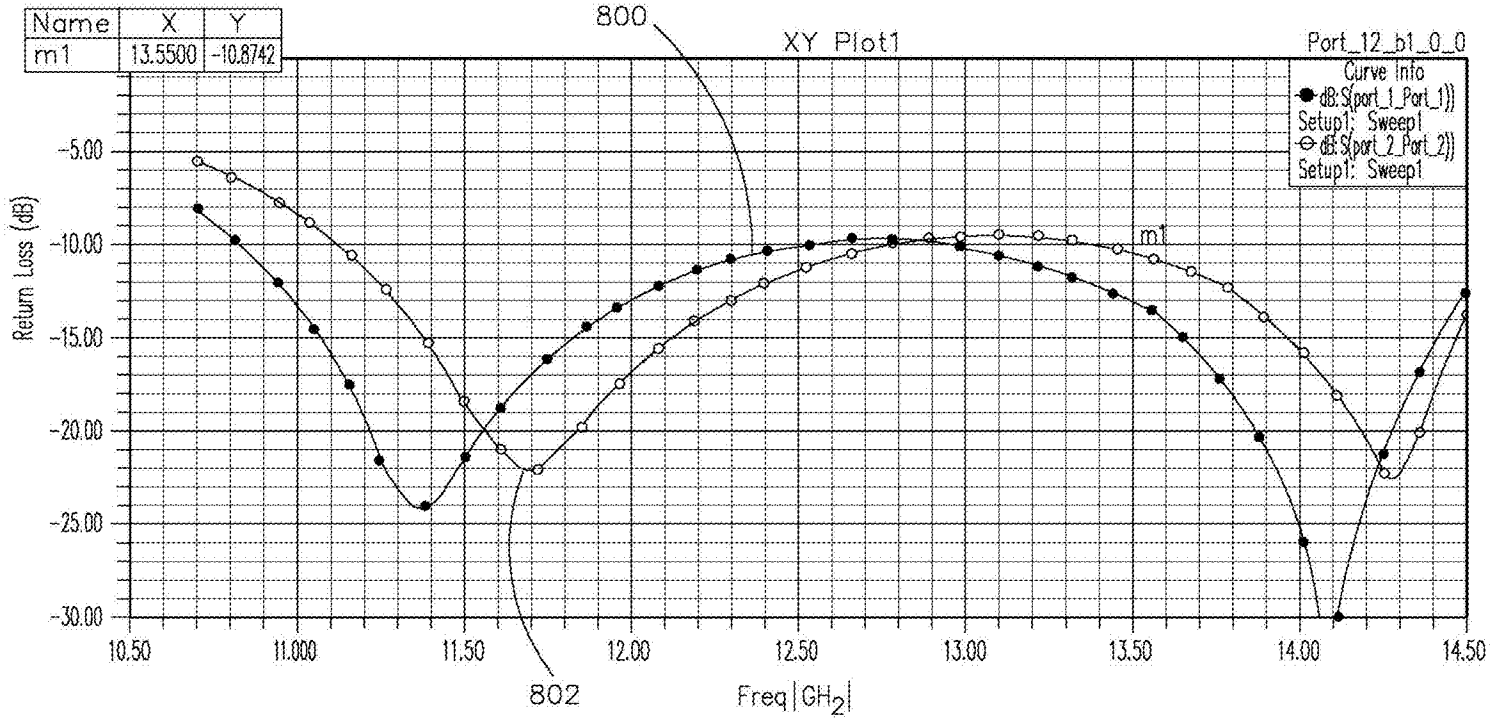
FIG. 8 shows a graphical representation of the performance of a radiating element according to at least one embodiment of the present invention.

Referring to FIG. 8, a graphical representation of the performance of a radiating element according to at least one embodiment of the present invention is shown. In at least exemplary embodiment of the present invention, the performance of a radiating element operating with θ (theta) of 30 degrees and ϕ (phi) of 29.97 degrees is shown in a frequency range of 10.7 to 14.5 GHz. Performance is measured as return loss in decibels. Return loss is shown for a horizontal polarization 800 and a vertical polarization 802.

Figure 9:
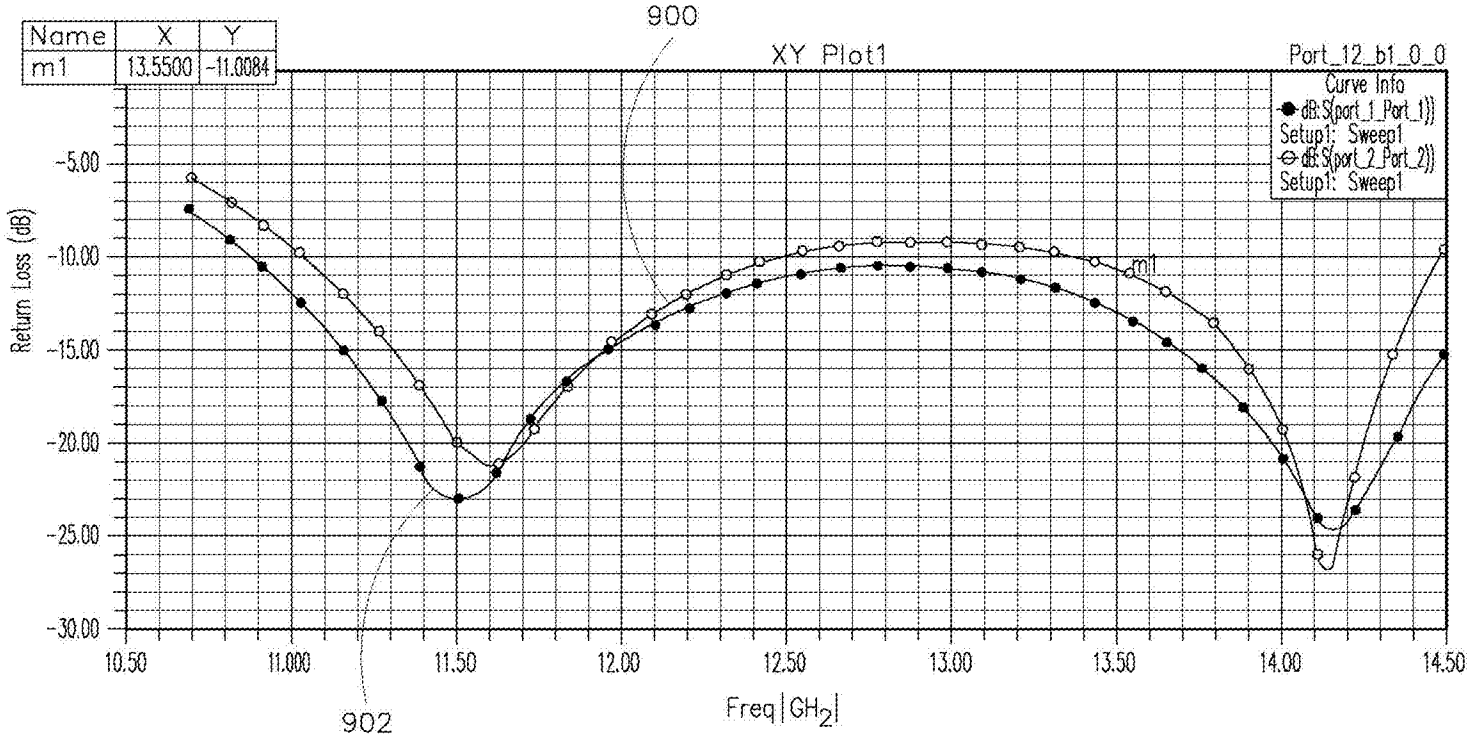
FIG. 9 shows a graphical representation of the performance of a radiating element according to at least one embodiment of the present invention.

Referring to FIG. 9, a graphical representation of the performance of a radiating element according to at least one embodiment of the present invention is shown. In at least exemplary embodiment of the present invention, the performance of a radiating element operating with θ (theta) of 30 degrees and ϕ (phi) of 60.03 degrees is shown in a frequency range of 10.7 to 14.5 GHz. Performance is measured as return loss in decibels. Return loss is shown for a horizontal polarization 900 and a vertical polarization 902.

Figure 10:
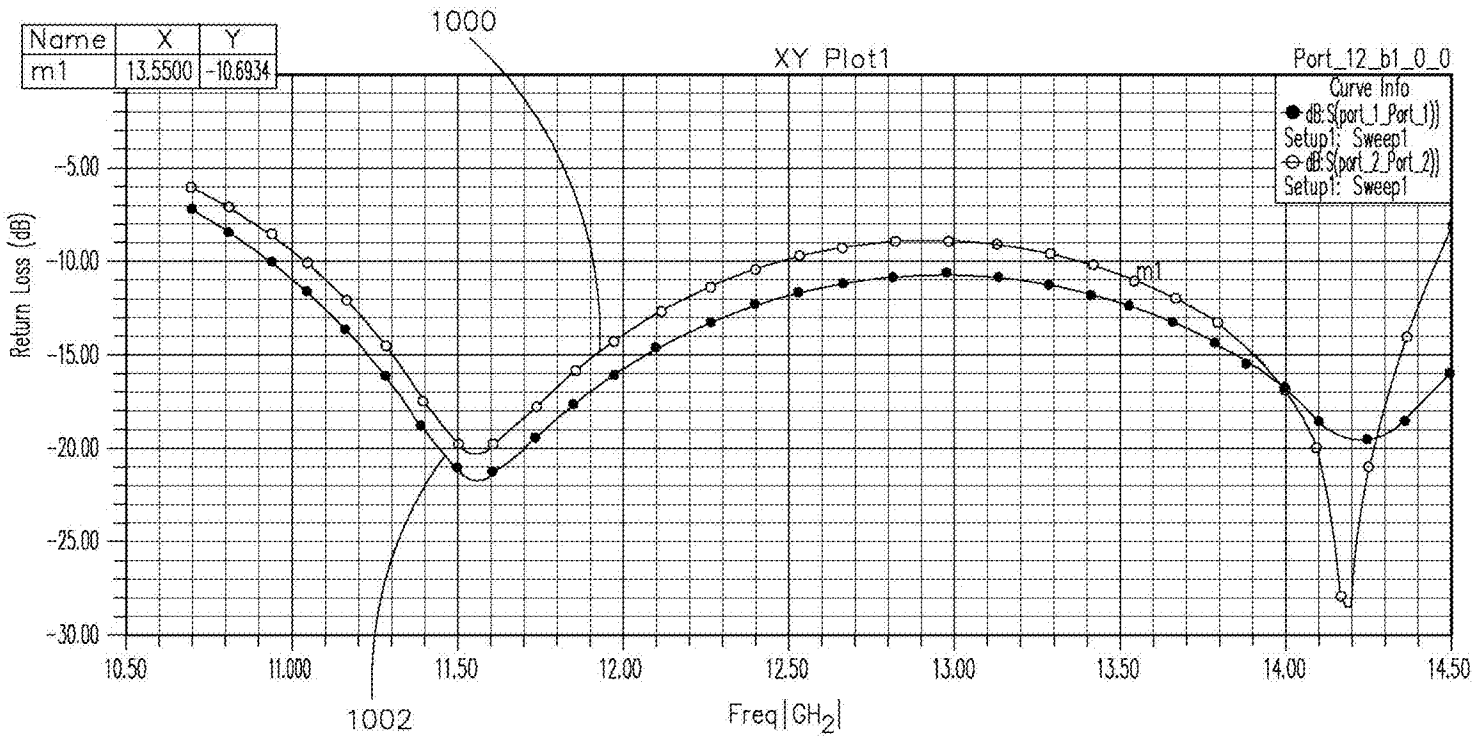
FIG. 10 shows a graphical representation of the performance of a radiating element according to at least one embodiment of the present invention.

Referring to FIG. 10, a graphical representation of the performance of a radiating element according to at least one embodiment of the present invention is shown. In at least exemplary embodiment of the present invention, the performance of a radiating element operating with θ (theta) of 30 degrees and ϕ (phi) of 90 degrees is shown in a frequency range of 10.7 to 14.5 GHz. Performance is measured as return loss in decibels. Return loss is shown for a horizontal polarization 1000 and a vertical polarization 1002.

Figure 11:
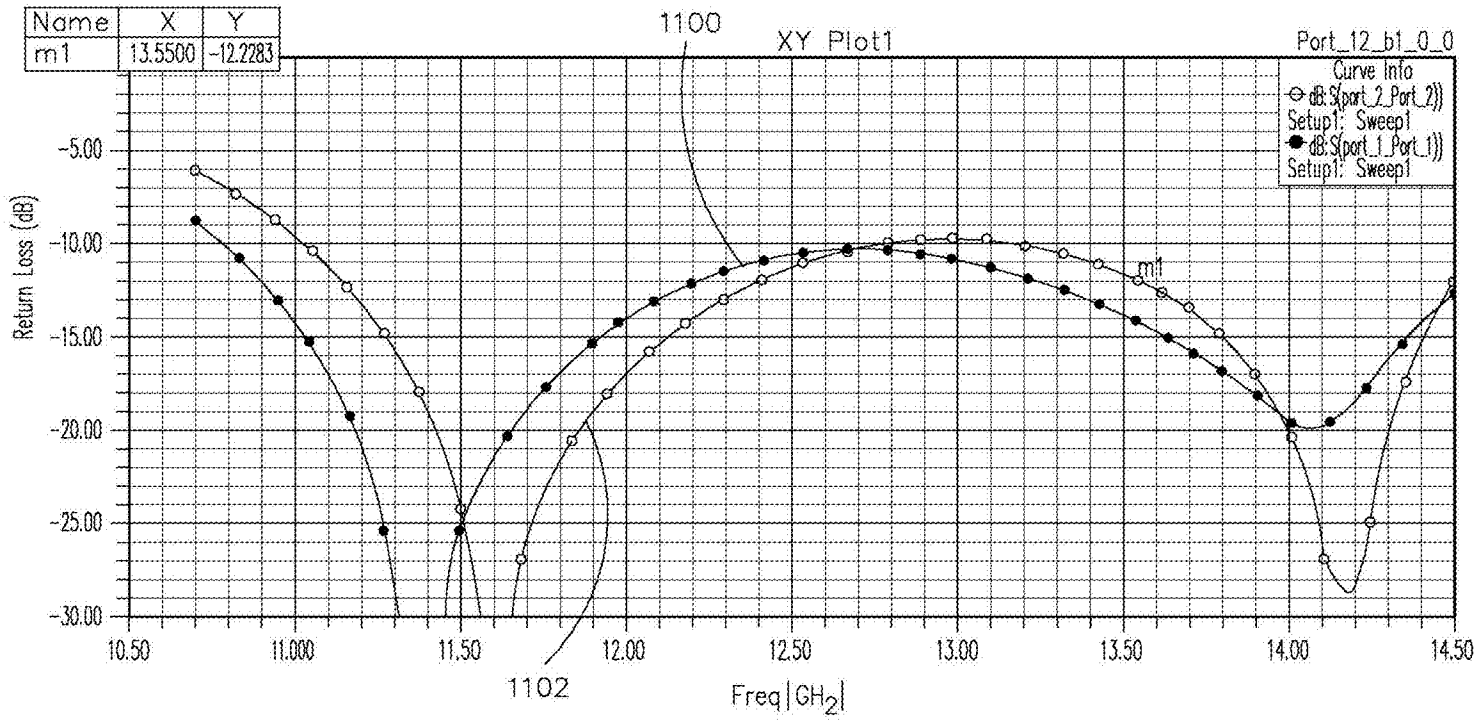
FIG. 11 shows a graphical representation of the performance of a radiating element according to at least one embodiment of the present invention.

Referring to FIG. 11, a graphical representation of the performance of a radiating element according to at least one embodiment of the present invention is shown. In at least exemplary embodiment of the present invention, the performance of a radiating element operating with θ (theta) of 0 degrees and ϕ (phi) of 0 degrees is shown in a frequency range of 10.7 to 14.5 GHz. Performance is measured as return loss in decibels. Return loss is shown for a horizontal polarization 1100 and a vertical polarization 1102.

It is believed that the present invention and many of its attendant advantages will be understood by the foregoing description of embodiments of the present invention, and it will be apparent that various changes may be made in the form, construction, and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. An electronically scanned array radiating element comprising:

a ground plane layer;

a lower metallization layer;

a mid metallization layer;

an upper metallization layer;

wherein each of the lower metallization layer, mid metallization layer and upper metallization layer comprises:

a first cluster of metallic dipoles, generally elongated along a first axis, configured to produce a signal having a first polarization; and a second cluster of metallic dipoles, generally elongated along a second axis, configured to produce a signal having a second polarization;

a first vertical probe and a second vertical probe, each connecting the ground plane layer to the lower metallization layer, mid-metallization layer and upper metallization layer, the first vertical probe associated with the first cluster of metallic dipoles and the second vertical probe associated with the second cluster of metallic dipoles, wherein:

the first axis is substantially orthogonal to the second axis; and the first polarization is substantially orthogonal to the second polarization.

2. The radiating element of claim 1, wherein the radiating element is configured to operate in the X and Ku bands.

3. The radiating element of claim 1, wherein the radiating element is configured to operate in a frequency range of 10.7 to 14.5 GHz with scan volume θ from 0 to 30° over all phi angles.

4. The radiating element of claim 1, wherein each of the lower metallization layer, mid metallization layer and upper metallization layer comprises a printed circuit pattern on FR-4 material.

5. The radiating element of claim 1, wherein the radiating element has return loss less than −10 dB out of 30° half conical scan angle for arbitrary phi angle.

6. The radiating element of claim 1, wherein the radiating element has a cell size of $0.25\lambda^2$ at 14.5 GHz.

7. An electronically scanned array (ESA) system comprising a radome layer;

a ground plane layer;

at least one metallization layer comprising:

a first cluster of metallic dipoles, generally elongated along a first axis, configured to produce a signal having a first polarization; and a second cluster of metallic dipoles, generally elongated along a second axis, configured to produce a signal having a second polarization;

a first vertical probe and a second vertical probe, each connecting the ground plane layer to a lower metallization layer, a mid-metallization layer and an upper metallization layer, the first vertical probe associated with the first cluster of metallic dipoles and the second vertical probe associated with the second cluster of metallic dipoles, wherein:

the first axis is substantially orthogonal to the second axis; and the first polarization is substantially orthogonal to the second polarization.

8. The electronically scanned array system of claim 7, wherein the radome layer comprises a layer of FR-4.

9. The electronically scanned array system of claim 7, wherein the at least one metallization layer comprises a printed circuit pattern on FR-4 material.

10. The electronically scanned array system of claim 8, wherein the electronically scanned array system is configured to operate in the X and Ku bands.

11. The electronically scanned array system of claim 8, wherein the electronically scanned array system is configured to operate in a frequency range of 10.7 to 14.5 GHz with scan volume θ from 0 to 30° over all phi angles.

12. The electronically scanned array system of claim 8, further comprising a module layer connected to the ground plane layer, the module layer configured to apply a signal to the ground plane layer and thereby to the first vertical probe and second vertical probe.

13. The electronically scanned array system of claim 8, wherein the electronically scanned array system has return loss less than −10 dB out of 30° half conical scan angle for arbitrary phi angle.

14. An antenna comprising:

a plurality of radiating elements, each radiating element comprising:

an aperture feed layer;

a ground plane layer;

at least one metallization layer comprising:

a first cluster of metallic dipoles, generally elongated along a first axis, configured to produce a signal having a first polarization; and a second cluster of metallic dipoles, generally elongated along a second axis, configured to produce a signal having a second polarization;

a first vertical probe and a second vertical probe, each connecting a ground plane layer to a lower metallization layer, a mid-metallization layer and an upper metallization layer, the first vertical probe associated with the first cluster of metallic dipoles and the second vertical probe associated with the second cluster of metallic dipoles, wherein:

the first axis is substantially orthogonal to the second axis; and the first polarization is substantially orthogonal to the second polarization.

15. The antenna of claim 14, further comprises a radome layer.

16. The antenna of claim 15, wherein the radome layer comprises a layer of FR-4.

17. The antenna of claim 15, wherein the at least one metallization layer comprises a printed circuit pattern on FR-4 material.

18. The antenna of claim 15, wherein each radiating element is configured to operate in the X and Ku bands.

19. The antenna of claim 15, wherein each radiating element is configured to operate in a frequency range of 10.7 to 14.5 GHz with scan volume θ from 0 to 30° over all phi angles.

20. The antenna of claim 15, wherein the antenna has return loss less than −10 dB out of 30° half conical scan angle for arbitrary phi angle.

* * * * *